US011242609B2

(12) United States Patent
Chen et al.

(10) Patent No.: US 11,242,609 B2
(45) Date of Patent: Feb. 8, 2022

(54) ACIDIC AQUEOUS SILVER-NICKEL ALLOY ELECTROPLATING COMPOSITIONS AND METHODS

(71) Applicant: Rohm and Haas Electronic Materials LLC, Marlborough, MA (US)

(72) Inventors: Jamie Y. C. Chen, Worcester, MA (US); Michael Lipschutz, Natick, MA (US); Miguel A. Rodriguez, Roxbury, MA (US); Kin Cheung Lo, On L ok Tsuen (HK)

(73) Assignee: ROHM AND HASS ELECTRONIC MATERIALS LLC, Marlborough, MA (US)

( * ) Notice: Subject to any disclaimer, the term of this patent is extended or adjusted under 35 U.S.C. 154(b) by 107 days.

(21) Appl. No.: 16/653,216

(22) Filed: Oct. 15, 2019

(65) Prior Publication Data

US 2021/0108324 A1 Apr. 15, 2021

(51) Int. Cl.
*C25D 3/64* (2006.01)

(52) U.S. Cl.
CPC ..... *C25D 3/64* (2013.01)

(58) Field of Classification Search
None
See application file for complete search history.

(56) References Cited

U.S. PATENT DOCUMENTS

| | | | | |
|---|---|---|---|---|
| 4,478,691 | A | 10/1984 | Abys | |
| 5,286,809 | A | 2/1994 | Heinz et al. | |
| 5,514,261 | A * | 5/1996 | Herklotz | C25D 3/64 106/1.23 |
| 6,099,713 | A | 8/2000 | Yanada et al. | |
| 6,251,249 | B1 | 6/2001 | Chevalier et al. | |
| 6,395,867 | B1 | 5/2002 | Maignan | |
| 7,273,540 | B2 | 9/2007 | Sonoda et al. | |
| 7,628,903 | B1 | 12/2009 | Tsuji et al. | |
| 7,938,948 | B2 | 5/2011 | Tsuji et al. | |
| 9,228,269 | B2 | 1/2016 | Okada et al. | |
| 9,797,056 | B2 | 10/2017 | Weyhmueller et al. | |
| 2005/0077186 | A1 | 4/2005 | Hansen et al. | |
| 2005/0175780 | A1 | 8/2005 | Sparing et al. | |
| 2005/0184369 | A1* | 8/2005 | Sonoda | C25D 3/60 257/677 |
| 2010/0216302 | A1* | 8/2010 | Luo | C23C 18/54 438/613 |
| 2019/0071789 | A1 | 3/2019 | Weyhmueller et al. | |

FOREIGN PATENT DOCUMENTS

| | | | |
|---|---|---|---|
| CN | 104120464 | A | 10/2014 |
| CN | 104611739 | A | 3/2015 |
| GB | 1283024 | | 1/1970 |
| JP | 3645955 | B2 | 5/2005 |

* cited by examiner

*Primary Examiner* — Wojciech Haske
(74) *Attorney, Agent, or Firm* — John J. Piskorski

(57) ABSTRACT

Silver-nickel alloy electroplating compositions and methods enable electroplating silver rich silver-nickel deposits which are bright, uniform and have a relatively low coefficient of friction. The binary silver-nickel alloy is deposited from an aqueous acid silver-nickel alloy electroplating composition. The aqueous acid silver-nickel alloy electroplating composition includes thiol compounds which shift the reduction potential of silver ions toward the reduction potential of nickel ions such that a silver rich binary silver-nickel layer is deposited on a substrate.

7 Claims, 2 Drawing Sheets

ACIDIC AQUEOUS SILVER-NICKEL ALLOY ELECTROPLATING COMPOSITIONS AND METHODS

FIELD OF THE INVENTION

The present invention is directed to acidic aqueous silver-nickel alloy electroplating compositions and methods. More specifically, the present invention is directed to acidic aqueous silver-nickel alloy electroplating compositions and methods, wherein the acidic aqueous silver-nickel alloy electroplating compositions include thiol compounds which shift the reduction potential of silver ions toward the reduction potential of nickel ions to enable electrodeposition of a silver rich silver-nickel alloy having good electrical conductivity, low electrical contact resistance and a low coefficient of friction.

BACKGROUND OF THE INVENTION

Silver and silver alloy plating baths are highly desirable for depositing silver and silver alloys on substrates in applications directed to the manufacture of electronic components and jewelry. Substantially pure silver is used as a contact finish because of its excellent electrical properties. It has high conductivity and low electrical contact resistance. However, its use as a contact finish for, example, electrical connectors is limited because of its poor resistance to mechanical wear and high silver-on-silver coefficient of friction. The poor resistance to mechanical wear results in the connector becoming physically damaged after a relatively low number of insertion-deinsertion cycles of the connector. A high coefficient of friction contributes to this wear problem. When connectors have a high coefficient of friction, the force required to insert and deinsert the connector is very high and this can damage the connector or limit the connector design options. Silver alloy deposits, such as silver-antimony and silver-tin, result in improved wear properties but have unacceptably poor contact resistance, especially after thermal aging. Maintaining good contact resistance upon exposure to high heat over time is important as silver alloys are commonly used in components for automobile engines and for electrical connectors which are exposed to high soldering temperatures.

Since many silver salts are substantially water-insoluble and silver salts which are water-soluble often form insoluble salts with various compounds commonly present in plating baths, the plating industry is faced with numerous challenges to formulate a silver or silver alloy plating bath which is stable long enough for practical plating applications and addresses at least the foregoing problems. Silver is an electrochemically noble metal with a standard reduction potential of about +0.8 V vs. the standard hydrogen electrode, thus alloy plating with other metals is challenging. The more negative the reduction potential of the alloying metal, the more difficult it is to plate silver with the alloying metal. Accordingly, there are significant limitations on the types of silver alloy plating baths that can be formulated for practical plating applications.

Many silver and silver-tin alloy plating baths include cyanide compounds to enable practical applications. However, cyanide compounds are extremely poisonous. Therefore, special waste water treatment is required. This results in a rise in treatment costs. Further, since these baths can only be used in the alkaline range, the types of alloying metals are limited. Many metals are not soluble under alkaline conditions and precipitate out of solution, such as metal hydroxides. Another disadvantage of alkaline baths is their incompatibility with many photoresist materials which are used to mask off areas on a substrate where plating is to be avoided. Such photoresists can dissolve under alkaline conditions.

Alkaline baths can also passivate substrates such that poor adhesion results between the plated metal and the substrate. This is often addressed by an extra step called "strike" plating which increases the number of processing steps, thus reducing the overall efficiency of the metal plating process.

Therefore, there is a need for a silver alloy plating bath which is stable, acidic, and deposits a silver-alloy which has high conductivity, low electrical contact resistance and a low coefficient of friction.

SUMMARY OF THE INVENTION

The present invention is directed to a silver-nickel alloy electroplating composition comprising a source of silver ions, a source of nickel ions, and a thiol compound, wherein the thiol compound shifts a reduction potential of silver ions toward a reduction potential of nickel ions, and a pH of less than 7.

The present invention is also directed to a method of electroplating a silver-nickel alloy on a substrate including:

a) providing the substrate;

b) contacting the substrate with a silver-nickel alloy electroplating composition comprising a source of silver ions, a source of nickel ions, and a thiol compound, wherein the thiol compound shifts a reduction potential of silver ions toward a reduction potential of nickel ions, and a pH of less than 7; and c) applying an electric current to the silver-nickel alloy electroplating composition and the substrate to electroplate a silver-nickel alloy deposit on the substrate.

The present invention is further directed to an article comprising a silver-nickel alloy layer adjacent a surface of a substrate, wherein the silver-nickel alloy layer comprises 50% to 99.9% silver and 0.1% to 50% nickel and has a coefficient of friction of 1 or less.

Including thiol compounds which shift the reduction potential of silver ions toward the reduction potential of nickel in an acidic environment enables deposition of a silver rich silver-nickel alloy on a substrate such that the silver rich silver-nickel alloy has substantially the good electrical properties of a silver deposit, such as good electrical conductivity and low electrical contact resistance. The contact resistance of the silver rich silver-nickel alloy can be just as good or better than that of gold. In addition, the silver rich silver-nickel alloy deposit has a low coefficient of friction such that the silver rich silver-nickel alloy deposit has good mechanical wear resistance. The silver rich silver-nickel deposit is uniform and bright in appearance. The silver-nickel alloy electroplating compositions of the present invention are stable.

DETAILED DESCRIPTION OF THE INVENTION

Figure 1:
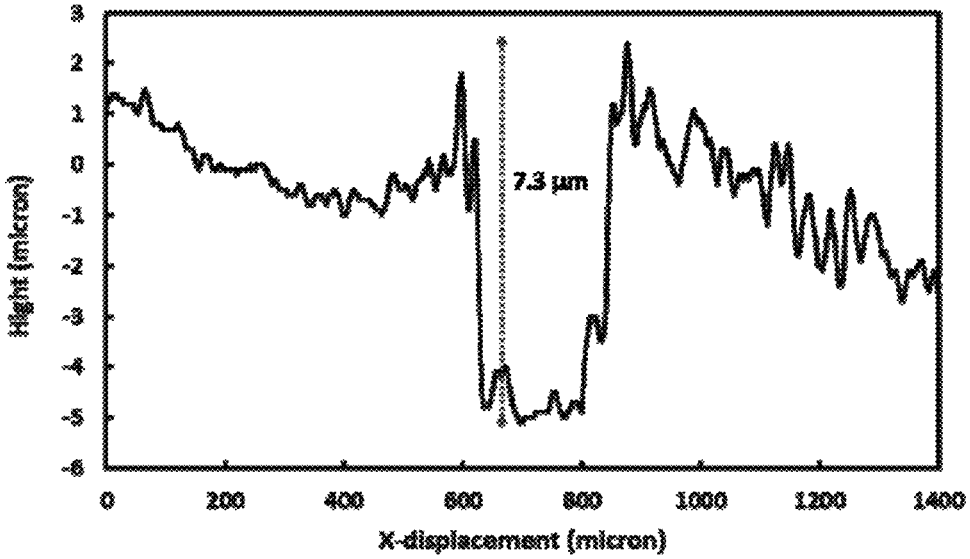
FIG. 1 is a 2D profilometry graphic of a surface of a silver metal deposit after 100 wear cycles, wherein the x-axis and y-axis are calibrated in microns (μm) where displacement means distance in microns from the left-hand side of the graphic.

As used throughout the specification the abbreviations have the following meanings, unless the context clearly indicates otherwise: ° C.=degrees Centigrade; g=gram; mg=milligram; L=liter; mL=milliliter; mm=millimeters; cm=centimeter; μm=microns; DI=deionized; A=amperes; ASD=amperes/$dm^2$=plating speed; DC=direct current; V=volts, which is the SI unit of electromotive force; mΩ=milliohms=electrical resistance; cN=centiNewtons=a unit of force; N=newtons; COF=coefficient of friction; rpm=revolutions per minute; s=seconds; 2D=two-dimensional; 3D=three-dimensional; Ag=silver; Ni=nickel; Au=gold; and Cu=copper.

The term "adjacent" means directly in contact with such that two metal layers have a common interface. The term "contact resistance" means electrical resistance arising from the contact between two electrically conductive articles measured as a function of applied force between those two articles. The term "reduction potential" means a measure of the tendency of metal ions to acquire electrons and thereby be reduced to metal. The abbreviation "N" means Newtons which is the SI unit of force and it is equal to the force that would give a mass of one kilogram an acceleration of one meter per second per second, and is equivalent to 100,000 dynes. The term "coefficient of friction" is a value that shows the relationship between the force of friction between two objects and the normal reaction between the objects that are involved; and is shown by $F_f=\mu F_n$, wherein $F_f$ is the frictional force, μ is the coefficient of friction and $F_n$ is the normal force, wherein normal force is the force applied between two articles which is perpendicular to the direction of relative motion between the two articles while measuring the frictional force between them. The term "tribology" means the science and engineering of interacting surfaces in relative motion and includes the study and application of the principles of lubrication, friction and wear. The term "wear resistance" means loss of material from a surface by means of mechanical action. The term "cold welding" means a solid-state welding process in which joining takes place without fusion or heating at the interface of the two parts to be welded and no molten liquid or molten phase is present in the joint. The term "thiocarbonyl group" means an organic chemical functional moiety of >C═S. The term "aqueous" means water or water-based. The terms "composition" and "bath" are used interchangeably throughout the specification. The terms "deposit" and "layer" are used interchangeably throughout the specification. The terms "electroplating", "plating" and "depositing" are used interchangeably throughout the specification. The term "matte" means dull or without luster. The term "binary alloy" means a metal alloy composed of two different metals. The term "ternary alloy" means a metal alloy composed of three different metals. The terms "a" and "an" can refer to both the singular and the plural throughout the specification. All percent (%) values and ranges indicate weight percent unless otherwise specified. All numerical ranges are inclusive and combinable in any order, except where it is logical that such numerical ranges are constrained to add up to 100%.

The present invention is directed to an acidic silver-nickel electroplating composition, wherein the acidic silver-nickel electroplating composition includes a source of silver ions, a source of nickel ions and a thiol compound, wherein the thiol compound shifts a reduction potential of silver ions toward a reduction potential of nickel ions such that the silver ions and nickel ions deposit on a substrate as a silver rich silver-nickel alloy. The bright and uniform silver rich silver-nickel alloy deposit has substantially good electrical properties, such as good electrical conductivity and low electrical contact resistance. The silver rich silver-nickel alloy deposit has a low coefficient of friction such that the silver rich silver-nickel alloy layers have good mechanical wear resistance. The acidic aqueous silver-nickel alloy electroplating compositions of the present invention are stable. Preferably, the acidic aqueous silver-nickel electroplating compositions are cyanide-free.

The reduction potential of silver ions is approximately +0.8 V and the reduction potential for nickel ions is approximately −0.24 V. While not being bound by theory, for silver ions and nickel ions to deposit substantially simultaneously to form a silver-nickel alloy deposit, the reduction potential of silver ions preferably is reduced to a reduction potential towards that of nickel ions. The reduction potential of silver ions may become less positive or may become negative. This is achieved by including select thiol compounds in the silver-nickel electroplating compositions in an acid environment which reduce the reduction potential of silver ions towards that of the nickel ions. In addition, such thiol compounds enable a stable, acidic silver ion containing bath formulation such that the silver ions do not precipitate out of solution as undesired water-insoluble silver compounds. Such thiol compounds themselves must be soluble in an aqueous acid environment.

Thiol compounds of the present invention include, but are not limited to, thiol compounds chosen from one or more of 2-mercaptosuccinic acid, 3-mercapto-1-propanesulfonic acid, 1-[2-(dimethylamino)ethyl]-1H-tetrazole-5-thiol, and salts thereof. Salts of the thiol compounds of the present invention include, but are not limited to, alkali metal salts such as sodium, potassium, lithium and cesium; ammonium salts; and tetraalkylammonium salts. Preferably, the thiol compounds are chosen from one or more of 2-mercaptosuccinic acid, 3-mercapto-1-propanesulfonic acid and sodium, 3-mercapto-1-propanesulfonate. More preferably, the thiol compounds are chosen from one or more of 2-mercaptosuccinic acid and sodium, 3-mercapto-1-propanesulfonate, most preferably, the thiol compound is 2-mercaptosuccinic acid.

The thiol compounds of the present invention are included in sufficient amounts to enable electroplating of a silver rich silver-nickel alloy in an aqueous acid environment. Preferably, the thiol compounds of the present invention are included in amounts of 5 g/L or greater, more preferably, the thiol compounds are included in amounts of 10 g/L to 100 g/L, further preferably, from 15 g/L to 90 g/L, even more preferably, from 20 g/L to 90 g/L, most preferably, from 30 g/L to 90 g/L.

The aqueous acid silver-nickel alloy electroplating compositions of the present invention include a source of silver ions. Sources of silver ions can be provided by silver salts such as, but not limited to, silver halides, silver gluconate, silver citrate, silver lactate, silver nitrate, silver sulfates, silver alkane sulfonates, silver alkanol sulfonates or mixtures thereof. When a silver halide is used, preferably the halide is chloride. Preferably, the silver salts are silver sulfate, a silver alkane sulfonate, silver nitrate, or mixtures thereof, more preferably, the silver salt is silver sulfate, silver methanesulfonate, or mixtures thereof. The silver salts are generally commercially available or can be prepared by methods described in the literature. Preferably, the silver salts are readily water-soluble. The amount of silver salts included in the acid silver-nickel electroplating compositions are in amounts sufficient to provide a desired bright and uniform silver rich silver-nickel alloy deposit. Preferably, silver salts are included in the compositions to provide silver ions at a concentration of at least 10 g/L, more preferably, silver salts are included in the compositions in amounts to provide silver ion concentrations in amounts of 10 g/L to 100 g/L, further preferably, silver salts are included in amounts to provide silver ion concentrations of 20 g/L to 80 g/L, even more preferably, silver salts are included in amounts to provide silver ions at concentrations of 20 g/L to 60 g/L, most preferably, silver salts are included in the compositions in amounts to provide silver ion concentrations of 30 g/L to 60 g/L.

A source of nickel ions is included in the aqueous acid silver-nickel alloy electroplating compositions of the present invention. Sources of nickel ions include, but are not limited to, nickel sulfate and its hydrated forms nickel sulfate hexahydrate and nickel sulfate heptahydrate, nickel sulfamate and its hydrated form nickel sulfamate tetrahydrate, nickel chloride and its hydrated form nickel chloride hexahydrate, nickel acetate and its hydrated form nickel acetate tetrahydrate, nickel nitrate, nickel nitrate hexahydrate, and mixtures thereof. Preferably, the source of nickel ions is nickel sulfamate and its hydrated form nickel sulfamate tetrahydrate, nickel nitrate and its hydrate form nickel nitrate hexahydrate, nickel chloride and its hydrated form nickel chloride hexahydrate, nickel sulfate and its hydrated forms nickel sulfate hexahydrate and nickel sulfate heptahydrate, more preferably, the source of nickel ions is nickel sulfamate and it hydrated form nickel sulfamate tetrahydrate, most preferably, the source of nickel ions is nickel sulfamate. Such nickel salts are commercially available or can be prepared by methods well known in the art.

Nickel salts are included in the aqueous acidic silver-nickel electroplating compositions in sufficient amounts to provide a desired bright and uniform silver rich silver-nickel alloy deposit. Preferably, sufficient nickel salts are added to provide nickel ion concentrations of at least 1 g/L, more preferably, from 1 g/L to 100 g/L, further preferably from 1 g/L to 80 g/L, even more preferably from 5 g/L to 80 g/L, still even more preferably from 5 g/L to 60, g/L, still further preferably from 5 g/L to 40 g/L, and most preferably from 5 g/L to 20 g/L.

Preferably, in the aqueous acid silver-nickel alloy electroplating compositions of the present invention, the water included as a solvent is at least one of deionized and distilled to limit incidental impurities.

Optionally, an acid can be included in the silver-nickel alloy electroplating compositions to assist in providing conductivity to the compositions. Acids include, but are not limited to, organic acids such as acetic acid, citric acid, arylsulfonic acids, alkanesulfonic acids, such as methanesulfonic acid, ethanesulfonic acid and propanesulfonic acid, aryl sulfonic acids such as phenylsulfonic acid and tolylsulfonic acid, and inorganic acids such as sulfuric acid, sulfamic acid, hydrochloric acid, hydrobromic acid and fluoroboric acid. Water-soluble salts of the foregoing acids also can be included in the silver-nickel alloy electroplating compositions of the present invention. Preferably, the acids are acetic acid, citric acid, alkane sulfonic acids, aryl sulfonic acids, sulfamic acid or salts thereof, more preferably the acids are acetic acid, citric acid, methanesulfonic acid, sulfamic acid or salts thereof. Such salts include, but are not limited to, methane sulfonate, sulfamate, citrate, sodium and potassium salts of the acids, such as sodium and potassium acetate, sodium citrate dibasic, sodium citrate monobasic, trisodium citrate, tripotassium citrate, dipotassium citrate, dipotassium citrate dibasic and potassium citrate monobasic. Although a mixture of acids can be used, preferably, when used, a single acid is used. The acids are generally commercially available or can be prepared by methods known in the literature. Such acids can be included in amounts to provide a desired conductivity. Preferably, the acids or salts thereof are included in amounts of at least 5 g/L, more preferably, from 10 g/L to 250 g/L, even more preferably, from 30 g/L to 150 g/L, most preferably from 30 g/1 to 125 g/L.

The pH of the aqueous acidic silver-nickel alloy electroplating composition is less than 7. Preferably, the pH is 0 to 6.5, more preferably, the pH is from 0 to 6, further preferably, the pH is from 1 to 6, even more preferably, the pH is from 2 to 6, most preferably, the pH is from 3 to 5.

Optionally, a pH adjusting agent can be included in the aqueous acid silver-nickel alloy compositions of the present invention. Such pH adjusting agents include inorganic acids, organic acids, inorganic bases or organic bases and salts thereof. Such acids include, but are not limited to, inorganic acids such as sulfuric acid, hydrochloric acid, sulfamic acid, boric acid, phosphoric acid and salts thereof. Organic acids include, but are not limited to, acetic acid, citric acid, amino acetic acid and ascorbic acid and salts thereof. Such salts include, but are not limited to, trisodium citrate. Inorganic bases such as sodium hydroxide and potassium hydroxide and organic bases such as various types of amines can be used. Preferably, the pH adjusting agents are chosen from acetic acid, citric acid and amino acetic acid and salts thereof, most preferably, acetic acid, citric acid and salts thereof. The pH adjusting agents can be added in amounts as needed to maintain a desired pH range.

Optionally, but preferably, a dihydroxy bis-sulfide compound or mixtures thereof can be included in the aqueous acid silver-nickel alloy electroplating compositions of the present invention. Such dihydroxy bis-sulfide compounds include, but are not limited to, 2,4-dithia-1,5-pentanediol, 2,5-dithia-1,6-hexanediol, 2,6-dithia-1,7-heptanediol, 2,7-dithia-1,8-octanediol, 2,8-dithia-1,9-nonanediol, 2,9-dithia-1,10-decanediol, 2,11-dithia-1,12-dodecanediol, 5,8-dithia-1,12-dodecanediol, 2,15-dithia-1,16-hexadecanediol, 2,21-dithia-1,22-doeicasanediol, 3,5-dithia-1,7-heptanediol, 3,6-dithia-1,8-octanediol, 3,8-dithia-1,10-decanediol, 3,10-dithia-1,8-dodecanediol, 3,13-dithia-1,15-pentadecanediol, 3,18-dithia-1,20-eicosanediol, 4,6-dithia-1,9-nonanediol, 4,7-dithia-1,10-decanediol, 4,11-dithia-1,14-tetradecanediol, 4,15-dithia-1,18-octadecanediol, 4,19-dithia-1,22-dodeicosanediol, 5,7-dithia-1,11-undecanediol, 5,9-dithia-1,13-tridecanediol, 5,13-dithia-1,17-heptadecanediol, 5,17-dithia-1,21-uneicosanediol and 1,8-dimethyl-3,6-dithia-1,8-octanediol. Preferably, the dihydroxy bis-sulfide compounds are chosen from 3,6-dithia-1,8-octanediol, 3,8-dithia-1,10-decanediol, 2,4-dithia-1,5-pentanediol, 2,5-dithia-1,6-hexanediol, 2,6-dithia-1,7-heptanediol, 2,7-dithia-1,8-octanediol, more preferably, 3,6-dithia-1,8-octanediol, 2,4-dithia-1,5-pentanediol, 2,5-dithia-1,6-hexanediol, 2,6-dithia-1,7-heptanediol, and 2,7-dithia-1,8-octanediol, even more preferably, 3,6-dithia-1,8-octanediol, 2,6-dithia-1,7-heptanediol, and 2,7-dithia-1,8-octanediol, most preferably, 3,6-dithia-1,8-octanediol.

Preferably, dihydroxy bis-sulfide compounds can be included in the aqueous acid silver-nickel alloy electroplating compositions in amounts of at least 5 g/L, more preferably, from 5 g/L to 80 g/L, even more preferably, from 15 g/L to 70 g/L, and most preferably, from 20 g/L to 60 g/L.

Optionally, but preferably, a thiocarbonyl group containing compound is included in the aqueous acid silver-nickel alloy electroplating compositions of the present invention. Such thiocarbonyl containing compounds include, but are not limited to, thioketones, thioaldehyde, thiocarbamate, thiourea and thiourea derivatives. Thiourea derivatives include, but are not limited to, thiocarbamate, guanylthiourea, 1-allyl-2-thiourea, 1-acetyl-2-thiourea, 1-bnezoyl-2-thiourea, 1-benzyl-2-thiourea, 1-butyl-3-phenyl-2-thiourea, 1,1-dimethyl-2-thiourea, tetramethyl-2-thiourea, 1,3-dimethyl thiourea, 1-methyl thiourea, 1,3-diethyl thiourea, 1,1-diphenyl-2-thiourea, 1,3-diphenyl-2-thiourea, 1,1-dipropyl-2-thiourea, 1,3-dipropyl-2-thiourea, 1,3-diisopropyl-2-thiourea, 1,3-di(2-tolyl)-2-thiourea, 1-methyl-3-phenyl-2-thiourea, 1(1-naphthyl)-3-phenyl-2-thiourea, 1(1-naphthyl)-2-thiourea, 1(2-naphthyl)-2-thiourea, 1-phenyl-2-thiourea, 1,1,3,3-tetramethyl-2-thiourea and 1,1,3,3-tetraphenyl-2-thiourea. Preferably, thiourea, guanylthiourea, 1-allyl-2-thiourea and 1,1,3,3-tetramethyl-2-thiourea are included in the silver-nickel alloy electroplating composition, more preferably, thiourea, guanylthiourea and 1,1,3,3-tetramethyl-2-thiourea are included in the silver-nickel alloy electroplating composition, most preferably, 1,1,3,3-tetramethyl-2-thiourea is included in the silver-nickel electroplating compositions of the present invention.

Preferably, thiourea and thiourea derivatives can be included in the aqueous acid silver-nickel electroplating compositions of the present invention in amounts of 0.01 g/L to 50 g/L, preferably, from 0.1 g/L to 40 g/L, more preferably, from 5 g/L to 40 g/L.

Optionally, a metallic brightening agent can be included in the aqueous acid silver-nickel alloy electroplating compositions of the present invention. Such metallic brightening agents include, but are not limited to, tellurium, selenium and antimony. Such brightening agents are not substantially incorporated in the silver-nickel alloys such that a ternary alloy is deposited. Such metallic brightening agents are added to the silver-nickel alloy electroplating compositions as water-soluble compounds. Preferably, the metallic brightening agent is chosen from tellurium, selenium, antimony or mixtures thereof. More preferably the metallic brightening agent is chosen from tellurium, selenium or mixtures thereof. Most preferably, the metallic brightening agent is tellurium. The water-soluble compounds are included in amounts sufficient to provide tellurium, selenium, antimony ions or mixtures thereof in amounts of 50 mg/L to 2 g/L, preferably, from 100 mg/L to 1 g/L, more preferably, from 200 mg/L to 1 g/L.

Sources of tellurium ions include, but are not limited to, telluric acid, tellurous acid, organotellurium compounds and tellurium dioxide. Organotellurium compounds include, but are not limited to, tellurol, telluroaldehyde, telluroketone, telluride, ditelluride, telluroxide, tellurone, tellurinic acid, alkyltellurium halides, dialkyltellurium dihalides, alkyltellurium trihalides, trialkyltellurium halides, dimethyl telluride and diphenyl ditelluride. Preferably the source of tellurium is telluric acid and tellurous acid. More preferably the source of tellurium is telluric acid which provides tellurium (VI) ions. Sources of selenium ions include, but are not limited to, selenium dioxide, selenic acid or mixtures thereof. Sources of antimony ions include, but are not limited to, potassium antimony tartrate.

Optionally, one or more surfactants can be included in the aqueous acid silver-nickel alloy electroplating compositions of the present invention. Such surfactants include, but are not limited to, ionic surfactants such as cationic and anionic surfactants, non-ionic surfactants and amphoteric surfactants. Surfactants can be included in conventional amounts such as 0.05 g/L to 30 g/L.

Examples of anionic surfactants are sodium di(1,3-dimethylbutyl) sulfosuccinate, sodium-2-ethylhexylsulfate, sodium diamyl sulfosuccinate, sodium lauryl sulfate, sodium lauryl ether-sulfate, sodium di-alkylsulfosuccinates and sodium dodecylbenzene sulfonate. Examples of cationic surfactants are quaternary ammonium salts such as perfluorinated quaternary amines.

Other optional additives can include, but are not limited to, levelers and biocides. Such optional additives can be included in conventional amounts.

Preferably, the acidic aqueous silver-nickel alloy electroplating compositions of the present invention are composed of water, silver ions and counter anions, nickel ions and counter anions, a thiol compound selected from the group consisting of 2-mercaptosuccinic acid, 3-mercapto-1-propanesulfonic acid, 1-[2-(dimethylamino)ethyl]-1H-tetrazole-5-thiol, salts thereof, and mixtures thereof, optionally a dihydroxy bis-sulfide compound, optionally a thiocarbonyl compound, optionally a metallic brightening agent, optionally an acid or salt thereof, optionally a pH adjusting agent, optionally a surfactant, and optionally a biocide, wherein a pH is less than 7.

Further preferably, the acidic aqueous silver-nickel alloy electroplating compositions of the present invention are composed of water, silver ions and counter anions, nickel ions and counter anions, a thiol compound selected from the group consisting of 2-mercaptosuccinic acid, 3-mercapto-1-propanesulfonic acid, 1-[2-(dimethylamino)ethyl]-1H-tetrazole-5-thiol, salts thereof, and mixtures thereof, a dihydroxy bis-sulfide compound, optionally a thiocarbonyl compound, optionally a metallic brightening agent, optionally an acid or salt thereof, optionally a pH adjusting agent, optionally a surfactant, and optionally a biocide, wherein a pH is 0-6.5.

More preferably, the acidic aqueous silver-nickel alloy electroplating compositions of the present invention are composed of water, silver ions and counter anions, nickel ions and counter anions, a thiol compound selected from the group consisting of 2-mercaptosuccinic acid, 3-mercapto-1-propanesulfonic acid, 1-[2-(dimethylamino)ethyl]-1H-tetrazole-5-thiol, salts thereof, and mixtures thereof, a dihydroxy bis-sulfide compound, a thiocarbonyl compound, optionally a metallic brightening agent, optionally an acid or salt thereof, optionally a pH adjusting agent, optionally a surfactant, and optionally a biocide, wherein a pH is 0-6.

Even more preferably, the acidic aqueous silver-nickel alloy electroplating compositions of the present invention are composed of water, silver ions and counter anions, nickel ions and counter anions, a thiol compound selected from the group consisting of 2-mercaptosuccinic acid, 3-mercapto-1-propanesulfonic acid, 1-[2-(dimethylamino)ethyl]-1H-tetrazole-5-thiol, salts thereof, and mixtures thereof, a dihydroxy bis-sulfide compound, a thiocarbonyl compound, a metallic brightening agent, optionally an acid or salt thereof, optionally a pH adjusting agent, optionally a surfactant, and optionally a biocide, wherein a pH is 1-6.5.

The acidic aqueous silver-nickel alloy electroplating compositions of the present invention can be used to deposit silver-nickel alloy layers on various substrates, both conductive and semiconductive substrates. Preferably, the substrates on which silver-nickel alloy layers are deposited are nickel, copper and copper alloy substrates. Such copper alloy substrates include, but are not limited to, brass and bronze. The electroplating composition temperatures during plating can range from room temperature to 70° C., preferably, from 30° C. to 60° C., more preferably, from 40° C. to 60° C. The silver-nickel alloy electroplating compositions are preferably under continuous agitation during electroplating.

The acidic aqueous silver-nickel alloy electroplating method of the present invention includes providing a substrate, providing the acidic aqueous silver-nickel alloy electroplating composition of the present invention and contacting the substrate with the acidic aqueous silver-nickel alloy electroplating composition such as by immersing the substrate in the composition or spraying the substrate with the composition. Applying a current with a conventional rectifier where the substrate functions as a cathode and there is present a counter electrode or anode. The anode can be any conventional soluble or insoluble anode used for electroplating binary silver-nickel alloys to deposit adjacent a surface of a substrate.

The acidic aqueous silver-nickel alloy electroplating compositions of the present invention enable deposition of bright and uniform silver rich binary silver-nickel alloy layers over broad current density ranges. The silver rich binary silver-nickel alloy includes 50% to 99.9% silver and 0.1% to 50% nickel, preferably, 50% to 99% silver and 1% to 50% nickel, more preferably, 50% to 98% silver and 2% to 50% nickel, excluding unavoidable impurities in the alloy.

Current densities for electroplating the bright and uniform silver rich silver-nickel alloy of the present invention can range from 0.1 ASD or higher. Preferably, the current densities range from 0.5 ASD to 70 ASD, further preferably, from 1 ASD to 40 ASD, more preferably, from 1 ASD to 30 ASD, even more preferably from 1 ASD to 15 ASD.

The thickness of the binary silver-nickel alloy layers of the present invention can vary depending on the function of the silver-nickel alloy layer and the type of substrate on which it is plated. Preferably, the silver-nickel alloy layer ranges from 0.1 μm or greater. Further preferably, the silver-nickel layers have thickness ranges of 0.1 μm to 100 μm, more preferably, from 0.5 μm to 50 μm, even more preferably, from 1 μm to 10 μm, most preferably from 1 μm to 5 μm.

While it is envisioned that the acidic aqueous silver-nickel alloy electroplating composition of the present invention can be used to plate various substrates which can include silver-nickel alloy layers, preferably, the acidic aqueous silver-nickel alloy electroplating composition of the present invention are used to electroplate top layers or coatings on electrical connectors where substantial contact forces and wear are expected to prevail. The silver rich silver-nickel alloy deposit is a highly desirable substitute for conventional silver coatings found on conventional connectors. The silver-nickel alloy deposit has good electrical conductivity and low electrical contact resistance. Contact resistance can be less than 4 mΩ at normal forces of 20 cN. In addition, the silver-nickel alloy deposit of the present invention has a low COF, preferably, a COF of 1 or less when measured with 1N of force. The COF of the silver-nickel alloy deposit of the present invention can have a COF of, preferably, 40% or less than the COF of substantially pure silver deposits, thus the silver-nickel alloy of the present invention has substantial improvement in wear resistance over substantially pure silver. Surface wear can be determined for a metal deposit according to conventional tribological and profilometry measurements well known in the art.

The following examples are included to further illustrate the invention but are not intended to limit its scope.

Silver-Nickel Alloy Electroplating Examples 1-12:

Unless otherwise noted, in all cases, the electroplating substrate was a 5 cm×5 cm brass (70% copper, 30% zinc) coupon. Prior to electroplating, the coupons were electrocleaned in RONACLEAN™ GP-300 LF electrolytic alkaline degreaser (available from DuPont de Nemours) at room temperature for 30 seconds with DC at a current density of 5 ASD. After electrocleaning, the coupons were rinsed with DI water, activated in 10% sulfuric acid for 30 seconds, rinsed with DI water again, then placed in the electroplating bath. Electroplating was performed with DC at a current density of 1 ASD (actual current applied is 0.28 A) for 6 minutes to deposit a silver-nickel deposit of about 2 μm. Electroplating was performed in a square, glass beaker using a platinized titanium anode. Agitation was provided by a 5 cm long, TEFLON-coated stir-bar at a rotation rate of 400 rpm. Electroplating was performed at a temperature of 55° C. All the silver-nickel electroplating baths were aqueous based. Water was added to each bath to bring it to a desired volume. The pH of the electroplating baths was adjusted with potassium hydroxide or methane sulfonic acid.

The thickness and elemental composition of the electroplated silver-nickel alloy was measured using a Bowman Series P X-Ray Fluorimeter (XRF) available from Bowman, Schaumburg, Ill. The XRF was calibrated using pure element thickness standards for silver and nickel from Bowman and calculated alloy composition and thickness by combining the pure element standards with Fundamental Parameter (FP) calculations from the XRF instruction manual.

EXAMPLE 1 (INVENTION)

An aqueous silver-nickel electroplating bath of the following composition was prepared:

Silver methanesulfonate to supply 20 g/L silver ions
2-mercaptosuccinic acid: 33.4 g/L
Nickel sulfamate to supply 5 g/L nickel ions
pH adjusted to 3

After electroplating, the electrodeposited coating appeared metallic and semi-bright. The silver-nickel alloy had a composition of 90% silver and 10% nickel.

EXAMPLE 2 (INVENTION)

An aqueous silver-nickel alloy electroplating bath of the following composition was prepared:

Silver methanesulfonate to supply 20 g/L silver ions
2-mercaptosuccinic acid: 33.4 g/L
1,1,3,3-tetramethyl-2-thiourea: 7.45 g/L
Nickel sulfamate to supply 5 g/L nickel ions
pH adjusted to 3.5

After electroplating, the electrodeposited coating appeared metallic and bright. The silver-nickel alloy was composed of 97.5% silver and 2.5% nickel.

EXAMPLE 3 (INVENTION)

An aqueous silver-nickel alloy electroplating bath of the following composition was prepared:

Silver methanesulfonate to supply 20 g/L silver ions
2-mercaptosuccinic acid: 33.4 g/L
3,6-Dithia-1,8-octanediol: 10.14 g/L
Nickel sulfamate to supply 5 g/L nickel ions
pH adjusted to 3

In this example, plating was performed at 3 ASD for 2 minutes. After electroplating, the electrodeposited coating appeared metallic and bright. The silver-nickel deposit was composed of 95% silver and 5% nickel.

EXAMPLE 4 (INVENTION)

An aqueous silver-nickel alloy electroplating bath of the following composition was prepared:

Silver methanesulfonate to supply 20 g/L silver ions
Sodium 3-mercapto-1-propane sulfonate: 49.6 g/L
Nickel sulfamate to supply 5 g/L nickel ions
Potassium citrate, tribasic: 50 g/L
Telluric acid sufficient to provide 1 g/L tellurium(VI) ions
pH adjusted to 4.5

After electroplating, the electrodeposited coating appeared metallic and bright. The silver-nickel electroplated deposit was composed of 98.5% silver and 1.5% nickel.

EXAMPLE 5 (INVENTION)

An aqueous silver-nickel alloy electroplating bath of the following composition was prepared:

Silver nitrate to supply 10 g/L silver ions
1-[2-(Dimethylamino)ethyl]-1H-tetrazole-5-thiol: 16.06 g/L
Nickel nitrate to supply 10 g/L nickel ions
Acetic acid: 6 g/L
pH adjusted to 4

After electroplating, the electrodeposited silver-nickel alloy coating appeared metallic and bright. The silver-nickel alloy had a composition of 98% silver and 2% nickel.

EXAMPLE 6 (COMPARATIVE)

An aqueous silver-nickel electroplating bath of the following composition was prepared:

Silver methanesulfonate to supply 20 g/L silver ions
Cysteine: 25.8 g/L
Methanesulfonic acid: 100 g/L
Nickel sulfamate to supply 5 g/L nickel ions
Telluric acid sufficient to provide 0.5 g/L tellurium(VI) ions
pH was approximately 0 (bath components were not soluble at higher pH).

After electroplating, the electrodeposited coating appeared metallic and bright. However, the deposit was 100% silver. No detectable nickel co-deposited with the silver.

EXAMPLE 7 (COMPARATIVE)

An aqueous silver-nickel electroplating bath of the following composition was prepared:

Silver methanesulfonate to supply 20 g/L silver ions
3-Mercapto-4-methyl-4H-1,2,4-triazole: 42.7 g/L
Methanesulfonic acid: 100 g/L
Nickel sulfamate to supply 5 g/L nickel ions
pH was approximately 0 (bath components were not soluble at higher pH).

After electroplating, the electrodeposited coating appeared black and non-adherent to the substrate. As in Example 6 above, the deposit was determined to be 100% silver. No detectable nickel co-deposited with the silver.

EXAMPLE 8 (COMPARATIVE)

An aqueous silver-nickel electroplating bath of the following composition was prepared:

Silver methanesulfonate to supply 20 g/L silver ions
Tetramethylthiourea: 49 g/L
Nickel sulfamate to supply 5 g/L nickel ions
pH was adjusted to 3

After electroplating, the electrodeposited coating was black and non-adherent to the substrate. The deposit was determined to be 100% silver. No nickel co-deposited with the silver.

EXAMPLE 9 (COMPARATIVE)

An aqueous silver-nickel electroplating bath of the following composition was prepared:

Silver methanesulfonate to supply 20 g/L silver ions
2-mercaptoimidazole: 39 g/L
Methanesulfonic acid: 100 g/L
Nickel sulfamate to supply 5 g/L nickel ions
pH was approximately 0 (bath components were not soluble at higher pH).

After electroplating, the electrodeposited coating appeared brown. The deposit was 100% silver. No nickel was co-deposited with the silver.

EXAMPLE 10 (COMPARATIVE)

An aqueous silver-nickel electroplating bath of the following composition was prepared:

Silver methanesulfonate to supply 20 g/L silver ions
2-mercaptopyridine: 43.3 g/L
Methanesulfonic acid: 100 g/L
Nickel sulfamate to supply 5 g/L nickel ions
pH was approximately 0 (bath components were not soluble at higher pH).

After electroplating, the electrodeposited coating appeared brown and non-adherent to the substrate. Analysis of the deposit indicated composition of 100% silver. No nickel was co-deposited.

EXAMPLE 11 (COMPARATIVE)

An aqueous silver-nickel electroplating bath of the following composition was prepared:

Silver methanesulfonate to supply 20 g/L silver ions
3,6-Dithia-1,8-octanediol: 100 g/L
Methanesulfonic acid: 100 g/L
Nickel sulfamate to supply 5 g/L nickel ions
pH was approximately 0 (bath components were not soluble at higher pH).

After electroplating, the electrodeposited coating appeared gray and matte. The deposit was composed of 100% silver. No nickel co-deposited with the silver.

EXAMPLE 12 (COMPARATIVE)

An aqueous silver-nickel electroplating bath of the following composition was prepared:

Silver methanesulfonate to supply 20 g/L silver ions
2-Imidazolidinethione: 40.7 g/L
Nickel sulfamate to supply 5 g/L nickel ions
pH was adjusted to 4

After electroplating, the electrodeposited coating appeared light brown and matte. The deposit was determined to be a composition of 100% silver. No nickel co-deposited on the substrate.

EXAMPLES 13-21 (COMPARATIVE)

Solubility of Thiol Compounds in Aqueous Acid Silver Solution

Solubility was evaluated using a silver ion concentration of 20 g/L. Solubility was tested at 1.1 and 2.1 molar equivalents of the thiol compounds listed in Table 1 relative to silver ions. Solubility was evaluated from very low pH of less than 1 at a concentration of 200 g/L methanesulfonic acid up to pH 6 at temperatures of 19° C. and 60° C. Tests were performed by dissolving silver methanesulfonate in water to make a solution of 20 g/L of silver ions. The thiol compound was then added, with stirring. A solid material always precipitated out of solution at this point. The pH was then adjusted incrementally either by adding methanesulfonic acid or potassium hydroxide. For all the thiol compounds, no pH from less than 1 to 6 was found where the precipitate was soluble.

TABLE 1

| Example (Comparative) | Thiol Compound | Solubility |
|---|---|---|
| 13 | 1-(4-hydroxyphenyl)-5-mercapto-1H-tetrazole | Precipitate |
| 14 | 2-amino-5-mercapto-1,3,4-thiadiazole | Precipitate |
| 15 | 1,3,4-thadiazole-2-thiol | Precipitate |
| 16 | 2-mercapto-5-methythio-1,3,4-thiadiazole | Precipitate |
| 17 | 6-(dibutylamino)-1,3,5-triazine-2,4,-dithiol | Precipitate |
| 18 | 2-mercaptobenzoxazole | Precipitate |
| 19 | Thiobenzoic acid | Precipitate |
| 20 | Sodium diethyldithiocarbamate | Precipitate |
| 21 | 2-mercaptotetrazole | Precipitate |

EXAMPLE 22 (INVENTION)

Contact Resistance Measurements

Contact resistance was evaluated using a custom designed apparatus containing a Starrett MTH-550 manual force tester stand equipped with a Starrett DFC-20 digital force gauge. The digital force gauge was equipped with a gold-plated copper probe with a hemispherical tip 2.5 mm in diameter. The electrical resistance of the contact between the gold-plated probe and the flat coupon plated with the silver alloy of interest was measured using a 4-wire resistance measurement as the contact force was varied. The current source was a Keithley 6220 DC Current Source and the voltmeter was a Keithley 2182A Nanovoltmeter. These instruments were operated in thermoelectric compensation mode for maximum accuracy.

Tests were performed using flat, brass coupons electroplated with about 3 μm of silver-nickel alloy from the aqueous acid silver-nickel alloy electroplating bath disclosed in Table 2 below. The pH of the bath was 3.5. The bath was stable for greater than one week prior to electroplating. The silver-nickel deposit appeared bright and uniform and composed of 97.4% silver and 2.6% nickel as determined by XRF. The contact partner was a gold-plated copper probe included in the apparatus described above.

TABLE 2

| Components | Amount |
|---|---|
| Mercaptosuccinic acid | 1.2 equivalents to silver ions |
| 1,1,3,3-tetramethyl-2-thiourea | 0.3 equivalents to silver ions |
| Silver methanesulfonate | 20 g/L |
| Nickel sulfamate | 5 g/L |

The brass coupons were electroplated in the aqueous acid silver-nickel alloy bath at 1 ASD for 6 minutes. For comparison, a brass coupon electroplated with an equivalent thickness of cobalt-hardened gold from RONOVAL™ CM electrolytic cobalt-hardened gold bath (available from DuPont de Nemours) was produced. Gold plating was done by the same procedure as the silver-nickel.

The contact resistance between the gold-plated copper probe and each of the coupons was measured. The results are in Table 3 below.

TABLE 3

| Contact Resistance | | |
|---|---|---|
| Force (cN) | AgNi/Brass (mΩ) | Au/Brass (mΩ) |
| 1 | 6 | 12 |
| 5 | 4 | 5.8 |
| 10 | 2.6 | 3.7 |
| 20 | 2.3 | 3 |
| 30 | 2 | 2.4 |
| 40 | 1.8 | 1.9 |
| 50 | 1.7 | 1.7 |
| 60 | 1.5 | 1.6 |
| 70 | 1.4 | 1.4 |
| 80 | 1.4 | 1.3 |
| 90 | 1.3 | 1.2 |
| 100 | 1.2 | 1.2 |

EXAMPLES 23 (INVENTION)

Thermal Aging Contact Resistance Measurements

Thermal ageing contact resistance was evaluated using the custom designed apparatus described in Example 22 above. Tests were performed using flat, C260 brass coupons electroplated with about 2 μm of silver-nickel alloy from the aqueous acid silver-nickel alloy electroplating bath disclosed in Table 4 below. The pH of the bath was 4.5. The silver-nickel deposit appeared bright and uniform and was composed of 97.5% silver and 2.5% nickel as determined by XRF.

TABLE 4

| Component | Amount |
|---|---|
| Silver ions from silver methane sulfonate | 20 g/L |
| Sodium 3-mercapto-1-propane sulfonate | 49.6 g/L |
| Nickel ions from nickel sulfamate | 5 g/L |
| Potassium citrate, tribasic | 50 g/L |
| Tellurium (VI) ions from telluric acid | 1 g/L |

Thermal ageing was done over 5 days at 150° C. After 5 days, the force and resistance were recorded. The results are in Table 5.

TABLE 5

| Force (cN) | AgNi/Brass (mΩ) | Au/Brass (mΩ) |
|---|---|---|
| 1 | 9 | 14 |
| 5 | 4 | 6 |
| 10 | 2.5 | 3.9 |
| 20 | 2 | 3 |
| 25 | 2 | 2.5 |
| 30 | 2 | 2.5 |
| 40 | 1.8 | 2 |
| 50 | 1.8 | 2 |
| 80 | 1.8 | 1.5 |
| 90 | 1.8 | 1.5 |
| 100 | 1.8 | 1.5 |

The silver-nickel alloy maintained excellent electrical properties even after 5 days of thermal aging, remaining on par with gold.

EXAMPLE 24 (COMPARATVE)

Silver Wear Resistance

Tribological measurements were performed using an Anton Paar TRB3 Pin-on-Disk tribometer equipped with a linear reciprocating stage (available from Anton Paar GmbH, Graz, Austria). All tests were performed using 1 N loading, a stroke length of 10 mm, and a sliding speed of 5 mm/s. All tests were performed "like-on-like", meaning that the flat coupon and the spherical ball were each plated with the same silver metal deposit produced from a SILVER GLO™ electrolytic silver bath available from DuPont de Nemours. The ball used was made of C260 brass (70% copper, 30% zinc) and was 5.55 mm in diameter and was electroplated with about 5 μm of silver. The flat coupon was also made of C260 brass and electroplated with about 5 μm of silver. During the test, coefficient of friction was monitored using the tribometer. Wear track depth was measured using laser profilometry. The measurements were done for 100 cycles where each cycle was one back and forth stroke of the ball on the coupon. 100 cycles was all that was required to break through the silver plated deposit. The profilometry measurements were performed using a Keyence VK-X Laser Scanning Confocal Microscope (available from Keyence Corporation of America, Elmwood Park, N.J.). The wear tracks were measured using laser profilometry at a magnification of 200X. The 3D and 2D profilometry graphics were created from these measurements using VK-X Analysis software from Keyence.

Figure 2:
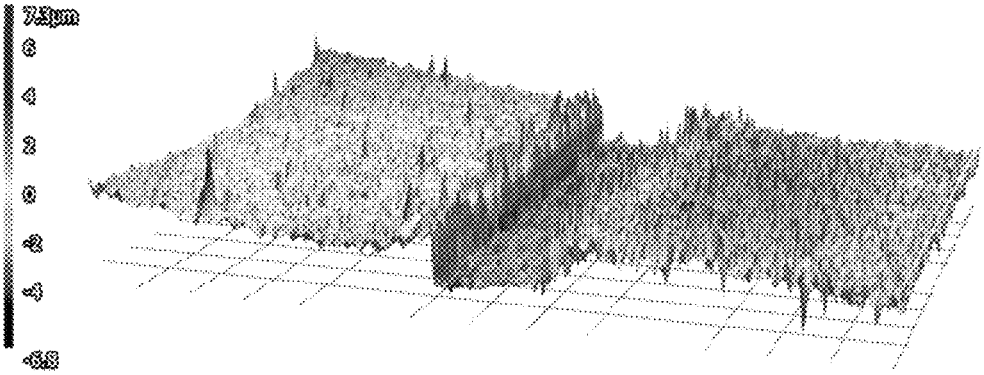
FIG. 2 is a 3D profilometry graphic of a surface of a silver metal deposit after 100 wear cycles, wherein the vertical scale refers to depth of indent-wear track calibrated in microns (μm).

FIG. 1 is the 2D profilometry graph of the silver deposit which shows major surface wear of the silver from 600 μm to 800 μm along the x-axis and from +2 μm to −5 μm along the y-axis. The vertical dotted line indicates the depth of the indent-wear track which is 7.3 μm. FIG. 2 is the 3D profilometry graph of the silver deposit which further exemplifies the serious surface wear of the silver deposit after 100 cycles. The scale shows the depth of the indent wear track as in FIG. 1.

The coefficient of friction (COF) was determined to be about 1.6. The COF was directly measured by the tribometer described above using the software Tribometer, version 8.1.5.

EXAMPLE 25 (INVENTION)

Silver-Nickel Alloy Wear Resistance

Tribological measurements were performed using the Anton Paar TRB3 Pin-on-Disk tribometer equipped with a linear reciprocating stage as in Example 24 above. All tests were performed using 1 N loading, a stroke length of 10 mm, and a sliding speed of 5 mm/s. The flat coupon and the spherical ball were each plated with the silver-nickel alloy of Table 4 in Example 23 above. The ball used was made of C260 brass (70% copper, 30% zinc) and was 5.55 mm in diameter and was electroplated with about 5 μm of the silver-nickel alloy. The flat coupon was also made of C260 brass and electroplated with about 2 μm of the alloy. During the test, coefficient of friction was monitored using the tribometer. Wear track depth was measured using the laser profilometry as in Example 24 with the Keyence VK-X Laser Scanning Confocal Microscope. The measurements were done for 500 cycles. The wear tracks were measured using laser profilometry at a magnification of 200X. A 3D profilometry graphic was created from these measurements using the software from Keyence.

Figure 3:
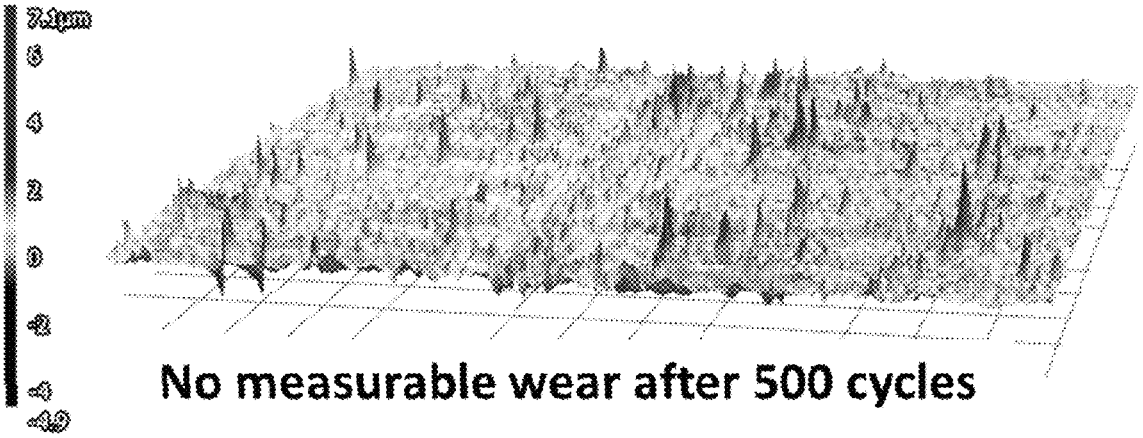
FIG. 3 is a 3D profilometry graphic after 500 wear cycles of a surface of a silver-nickel alloy deposit of the invention wherein the alloy is composed of 97.5% silver and 2.5% nickel, and the vertical scale refers to depth of indent-wear track calibrated in microns (μm).

FIG. 3 is the 3D profilometry graph of the silver-nickel deposit. There is no indication of surface wear even after 500 cycles. The coefficient of friction was determined to be about 1 which is a 40% reduction over the silver in Example 24.

What is claimed is:

1. A silver-nickel alloy electroplating composition composed of water, silver ions and counter anions, nickel ions and counter anions, a thiol compound selected from the group consisting of 2-mercaptosuccinic acid, 3-mercapto-1-propanesulfonic acid, 1-[2-(dimethylamino)ethyl]-1H-tetrazole-5-thiol, salts thereof and mixtures thereof, optionally a dihydroxy bis-sulfide compound, optionally a thiocarbonyl compound, optionally a metallic brightening agent, optionally an acid or salt thereof, optionally a pH adjusting agent, optionally a surfactant and optionally a biocide, wherein a pH is less than 7.

2. The silver-nickel alloy electroplating composition of claim 1, wherein the pH is from 0 to 6.5.

3. The silver-nickel alloy electroplating composition of claim 1, wherein the thiol compound is in amounts of 5 g/L or greater.

4. The silver-nickel alloy electroplating composition of claim 3, wherein the thiol compound is in amounts of 10-100 g/L.

5. The silver-nickel alloy electroplating composition of claim 4, wherein the thiol compound is in amounts of 15-90 g/L.

6. A method of electroplating nickel metal on a substrate comprising:

a) providing the substrate;

b) contacting the substrate with a silver-nickel alloy electroplating composition composed of water, silver ions and counter anions, nickel ions and counter anions, a thiol compound selected from the group consisting of 2-mercaptosuccinic acid, 3-mercapto-1-propanesulfonic acid, 1-[2-(dimethylamino)ethyl]-1H-tetrazole-5-thiol, salts thereof and mixtures thereof, optionally a dihydroxy bis-sulfide compound, optionally a thiocarbonyl compound, optionally a metallic brightening agent, optionally an acid or salt thereof, optionally a pH adjusting agent, optionally a surfactant and optionally a biocide, wherein a pH is less than 7; and c) applying an electric current to the silver-nickel alloy electroplating composition and substrate to electroplate a silver-nickel deposit on the substrate.

7. The method of claim 6, wherein the silver-nickel alloy electroplating composition has a pH of 0 to 6.5.

* * * * *